US011939833B2

(12) United States Patent
Lende et al.

(10) Patent No.: US 11,939,833 B2
(45) Date of Patent: Mar. 26, 2024

(54) RETRIEVABLE WIPER PLUG WITH FISHING NECK

(71) Applicant: Halliburton Energy Services, Inc., Houston, TX (US)

(72) Inventors: Gunnar Lende, Tananger (NO); Khahlil Rehman, Tananger (NO)

(73) Assignee: Halliburton Energy Services, Inc., Houston, TX (US)

( * ) Notice: Subject to any disclaimer, the term of this patent is extended or adjusted under 35 U.S.C. 154(b) by 3 days.

(21) Appl. No.: 17/663,039

(22) Filed: May 12, 2022

(65) Prior Publication Data

US 2023/0084710 A1 Mar. 16, 2023

Related U.S. Application Data

(60) Provisional application No. 63/261,264, filed on Sep. 16, 2021.

(51) Int. Cl.

| | |
|---|---|
| ***E21B 33/12*** | (2006.01) |
| ***E21B 31/00*** | (2006.01) |
| ***E21B 33/14*** | (2006.01) |

(52) U.S. Cl.

CPC ..... *E21B 33/12* (2013.01); *E21B 31/00* (2013.01); *E21B 33/14* (2013.01)

(58) Field of Classification Search

CPC ..... E21B 33/16

See application file for complete search history.

(56) References Cited

U.S. PATENT DOCUMENTS

| | | | | |
|---|---|---|---|---|
| 4,532,989 | A * | 8/1985 | Barker | E21B 33/12 166/188 |
| 4,986,361 | A * | 1/1991 | Mueller | E21B 23/08 166/381 |
| 2007/0277970 | A1 | 12/2007 | Botnmark et al. | |
| 2012/0234561 | A1* | 9/2012 | Hall | E21B 23/02 166/386 |
| 2013/0138254 | A1 | 5/2013 | Seals et al. | |
| 2014/0374089 | A1 | 12/2014 | Coles | |
| 2019/0186228 | A1* | 6/2019 | Beckett | E21B 33/16 |
| 2020/0173252 | A1 | 6/2020 | Lende et al. | |
| 2021/0140275 | A1* | 5/2021 | Nanney | E21B 33/16 |

* cited by examiner

*Primary Examiner* — William D Hutton, Jr.
*Assistant Examiner* — Avi T Skaist
(74) *Attorney, Agent, or Firm* — Sheri Higgins; Sheri Higgins Law, PLLC

(57) ABSTRACT

A wiper plug can be used in wellbore operations. The wiper plug can include a fishing neck located at a rear portion of the plug. The fishing neck can be a male or female fishing neck. A corresponding male or female fishing tool can be used to retrieve the wiper plug from a tubing string. The wiper plug can include a nose that can land on a landing tool or a female fishing neck of another wiper plug. The wiper plug can be introduced into the tubing string before or after a cement composition. The wiper plug can include a rupture disk that allows an operator at a wellhead to observe a pressure change to indicate the location of the wiper plug and fluid within the tubing string.

20 Claims, 5 Drawing Sheets

RETRIEVABLE WIPER PLUG WITH FISHING NECK

TECHNICAL FIELD

A wiper plug can be used in a variety of wellbore operations. The wiper plug can include a fishing neck. A fishing tool can engage with the fishing neck in order to retrieve the wiper plug from the wellbore.

BRIEF DESCRIPTION OF THE FIGURES

The features and advantages of certain embodiments will be more readily appreciated when considered in conjunction with the accompanying figures. The figures are not to be construed as limiting any of the embodiments.

DETAILED DESCRIPTION

Figure 1:
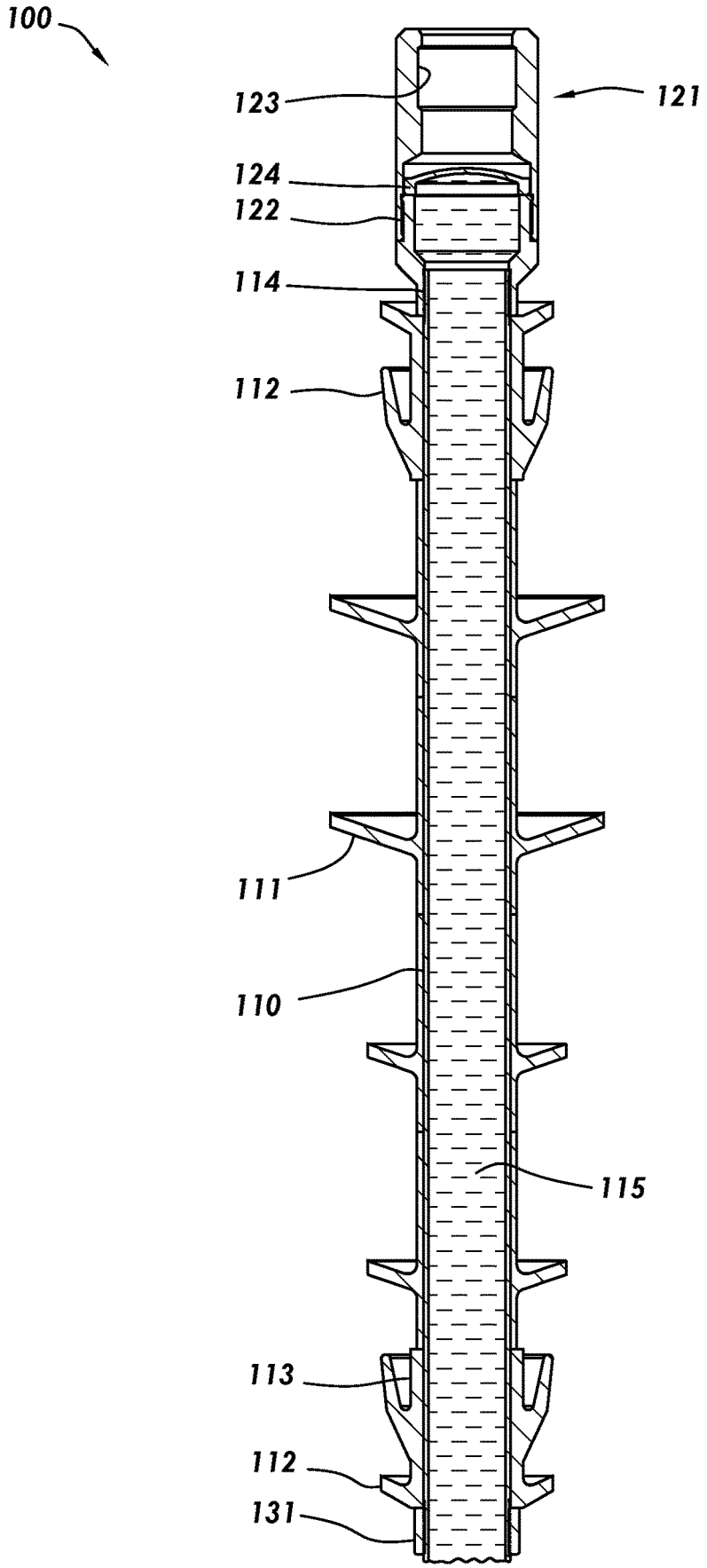
FIG. 1 is a cross-sectional view of a wiper plug without a nose according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water found in or produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore. A cased-hole wellbore can also contain a tubing string. A wellbore can contain an annulus. Examples of an annulus include, but are not limited to, the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Wellbore treatment operations can be performed in a wellbore. During well completion, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into or out from the annulus. Consequently, oil or gas can be produced in a controlled manner by directing the flow of oil or gas through the casing and into the wellhead. Cement compositions can also be used in primary or secondary cementing operations, well-plugging for well abandonment, or squeeze cementing. As used herein, a "cement composition" is a mixture of at least cement and water, and possibly other additives.

A wiper plug can be used in wellbore treatment operations. A wiper plug can be pumped into a tubing string and cement can be pumped into the tubing string before or after the wiper plug. A wiper plug can also be used before and after the cement and the cement can be left inside the tubing string. In other examples, a wiper plug can be pumped through a tubing string to ensure there is a free path and to caliper the tubing string volume.

Wiper plugs are generally composed of a body, a mandrel, and one or more wiper cups. The wiper cups can be located circumferentially around the outside of the mandrel and can function to "wipe" the inside of the tubing string and separate fluids as the plug is being pumped into the wellbore. Wiper cups can also wipe any fluid on the inside of the tubing string to avoid a cement sheath inside the tubing string above the last wiper plug.

Some wiper plugs are designed to remain in the wellbore after use. However, there are several disadvantages to wiper plugs that cannot be removed from the wellbore. By way of a first example, if a wiper plug is used to caliper a tubing string volume and encounters a damaged or collapsed section of tubing string, then repairs to the tubing string cannot be made until the wiper plug is removed from the tubing string. By way of a second example, tagging of the location of a cement composition cannot be accomplished if the wiper plug is in the tubing string. Tagging generally involves introducing a mechanical tag device into the tubing string, for example via wireline, that contacts the top of the cement column until a force is created upon it. However, tagging requires physical access to the top of the cement column. Accordingly, if a wiper plug remains in the wellbore, then physical access to the top of the cement column is not possible and tagging cannot occur.

In situations where it is desirable to remove a wiper plug, the wiper plug can be removed by drilling or milling. However, not only is removal by drilling or milling expensive and time consuming, but it also damages the wiper plug and possibly other downhole tools. Additionally, such activities require bringing a suitable unit, such as a drilling rig or a coiled tubing to the wellsite. Currently there is not a way to retrieve a wiper plug after use with a simple wireline operation. As such, there is a need and on-going industry concern to be able to retrieve wiper plugs after use.

It has been discovered that a wiper plug can be retrieved from a wellbore. The wiper plug can include a fishing neck whereby a fishing tool can matingly engage with the fishing neck to retrieve the wiper plug. The wiper plug can also include a nose. The wiper plug can be stacked on a second wiper plug.

A wiper plug can include an inner mandrel; one or more wiper cups located circumferentially around the inner mandrel; and a fishing neck connected to a rear portion of the inner mandrel.

A method of plugging a well can include introducing the wiper plug into a tubing string located within the wellbore, and retrieving the wiper plug from the tubing string.

The various disclosed embodiments apply to the systems, methods, and apparatuses without the need to repeat the various embodiments throughout. As used herein, any reference to the unit "gallons" means U.S. gallons.

Turning to the figures, FIG. 1 is a longitudinal, cross-sectional view of a wiper plug 100 according to certain embodiments. The wiper plug 100 can include an inner mandrel 110. The inner mandrel 110 can have a variety of dimensions. The inner mandrel 110 can include an inner diameter (ID) and an outer diameter (OD) that defines a thickness of the inner mandrel 110. The inner mandrel 110 can include a cavity that allows a fluid to flow through the inner mandrel 110. The ID of the inner mandrel 110 can range from 0.5 to 20 inches. The OD of the inner mandrel 110 can range from 0.7 to 22 inches. The length of the inner mandrel 110 can range from 10 to 80 inches. The dimensions of the inner mandrel 110 can be selected such that the wiper plug 100 is capable of being introduced into a tubing string. The inner mandrel 110 can be made from metals, metal alloys, hard plastics, composites, or fiber reinforced resins for example.

The wiper plug 100 can include one or more wiper cups 111 located circumferentially around the outside of the inner mandrel 110. The wiper cups 111 can be slid, threaded, or molded onto the outside of the inner mandrel 110. A plurality of wiper cups 111 can also be used. The OD of the wiper cups 111 can be the same or different. Different sized wiper cups 111 can be used to wipe different sized tubing strings. The wiper cups 111 can be made of commonly known materials, for example, natural or synthetic rubber, urethane elastomers, or plastics that provide flexibility to the wiper cups 111. A variety of wiper cups 111 can be used for the wiper plug 100. The geometric shape of the wiper cups 111 can vary. The angle at which the wiper cups 111 extend away from the inner mandrel 110 towards the ID of a tubing or casing string can also vary and be selected such that the wiper cups engage in a wiping action on the inside of the tubing or casing string. The thickness of the wiper cups 111 can also vary. The shape, angle, thickness, and total number of wiper cups 111 can be selected to provide multiple external steps or compound angles targeted at multiple inner diameters the wiper plug 100 must pass through. In this manner, the wiper cups 111 can engage with a variety of different inner diameters and function to wipe the inside of different sized tubing or casing strings.

Figure 2:
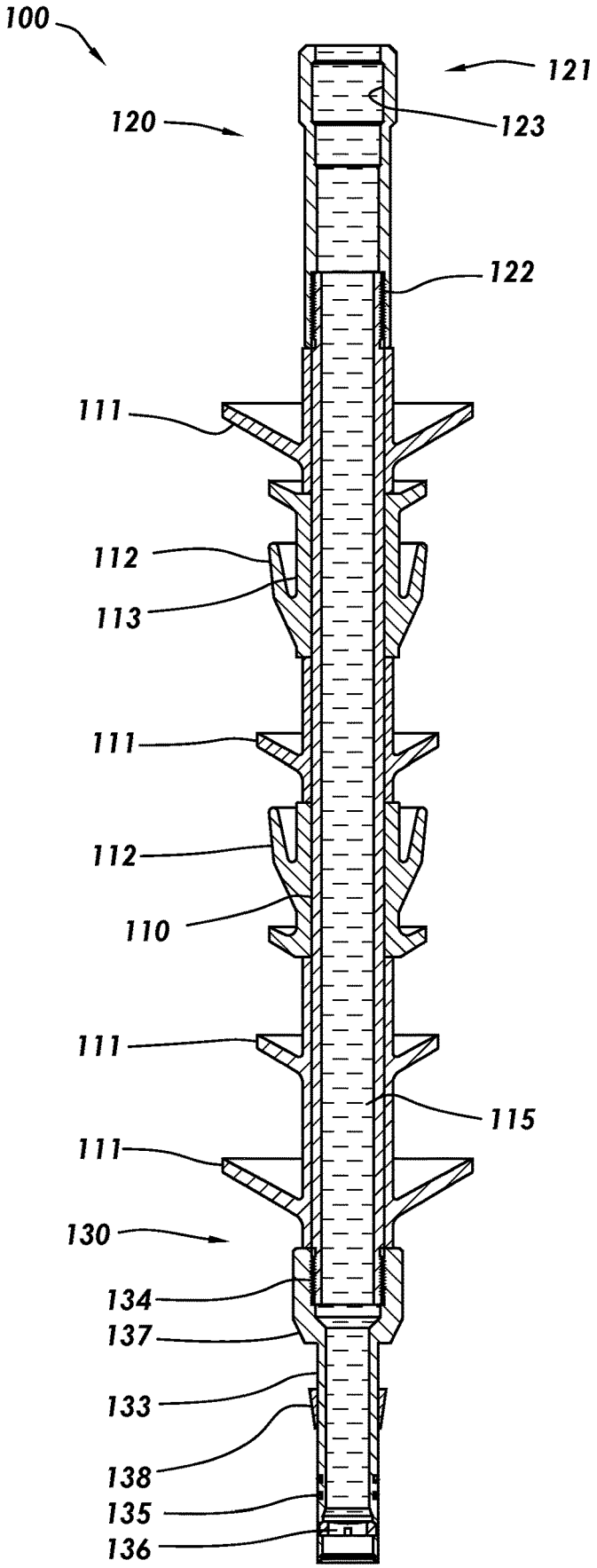
FIG. 2 is a cross-sectional view of a wiper plug with a nose according to certain other embodiments.

The wiper plug 100 can also include one or more wiper cup connectors 112. The wiper cup connectors 112 can be made from metals, metal alloys, hard plastics, fiber reinforced resins, or glass. The wiper cup connectors 112 can be located on each side of the wiper cups 111, for example as shown in FIG. 1. The wiper cup connectors 112 can constrain the wiper cups 111 on the outside of the inner mandrel 110 and prohibit or prevent movement along a longitudinal axis of the inner mandrel 110. As shown in FIG. 2, wiper cup connectors 112 and other components of the wiper plug 100 can be used to constrain the wiper cups 111 on the outside of the inner mandrel 110. The wiper cup connectors 112 can be permanently or temporarily connected to the inner mandrel 110. The wiper cup connectors 112 can include a wiper cup connector mandrel 113 and connector threads 114. The connector threads 114 can be used to thread the connector mandrel 113 to the outside of the inner mandrel 110. In this manner, once the wiper cup connectors 112 are permanently or temporarily connected to the inner mandrel 110, the wiper cups 111 can be constrained on the outside of the inner mandrel 110.

According to any of the embodiments, the wiper plug 100 is introduced into a tubing string in a wellbore. The wiper plug 100 can be introduced after a cement composition has been introduced into the wellbore. According to these embodiments, a front portion 130 (i.e., the first part of the wiper plug that would be placed within the tubing string) of the wiper plug 100 does not engage with a landing tool. Accordingly, the front portion 130 can include a nut 131. The nut 131 can include threads 132 for removably securing the nut 131 to inner mandrel 110 at the front portion 130 of the wiper plug 100.

According to any of the embodiments, the cavity of the inner mandrel 110 can contain a fluid 115. The fluid 115 can be an incompressible fluid, for example, a gel. The fluid 115 can prevent a wellbore fluid, for example a drilling fluid, spacer fluid, or cement composition, from entering the inner mandrel 110 during introduction of the wiper plug 100. According to these embodiments, if the wiper plug 100 includes a rupture disk 124 located at the rear portion 120 of the inner mandrel 110, then the cavity can be filled with the incompressible fluid. However, if the wiper plug 100 includes a rupture disk 136 located in the nose 133, then the cavity of the inner mandrel 110 may not need to be filled with the incompressible fluid but can be.

The wiper plug 100 can have a rupture disk 124 located near a rear portion 120 of the wiper plug 100. A connector can be used to house the rupture disk 124 in relation to the inner mandrel 110. The rupture disk 124 can be used for a variety of purposes, such as an indicator for cement location within the tubing string. In this manner, when a pressure change is observed at the wellhead by an operator, the location of the wiper plug 100 and any wellbore fluids can be indicated. The pressure differential across the rupture disk 124 can be increased to a pressure above the pressure tolerance of the rupture disk 124, which can rupture the rupture disk 124. After the rupture disk 124 is ruptured, fluid can flow through the inner mandrel 110.

FIG. 2 is a wiper plug 100 according to other embodiments. The wiper plug 100 can include a nose 133 located at the front portion 130 of the inner mandrel 110. The nose 133 can be permanently or removably connected to the inner mandrel 110. The nose 133 can be connected to the inner mandrel 110 via internal or external threads (shown in FIG. 2 with external threads 134), glue, soldering, or welding, for example. The nose 133 can be made from metals, metal alloys, hard plastics, or fiber reinforced resins.

The nose 133 can have a variety of dimensions and shapes. The outer profile of the nose 133 can be selected such that the nose can land on a landing tool or another wiper plug (discussed in more detail below). The nose 133 can include an interior cavity that allows fluids to flow through the nose. The nose 133 can include one or more sealing elements 135, such as O-rings, located around an outside of the nose 133. The nose 133 can also have a solid portion. The nose 133 can also include a rupture disk 136. Prior to rupturing of the rupture disk 136, fluid can be prevented from flowing out of or into the inner mandrel 110 via the nose 133. After rupturing, fluid can flow through the inner mandrel 110 and the nose 133.

Figure 3:
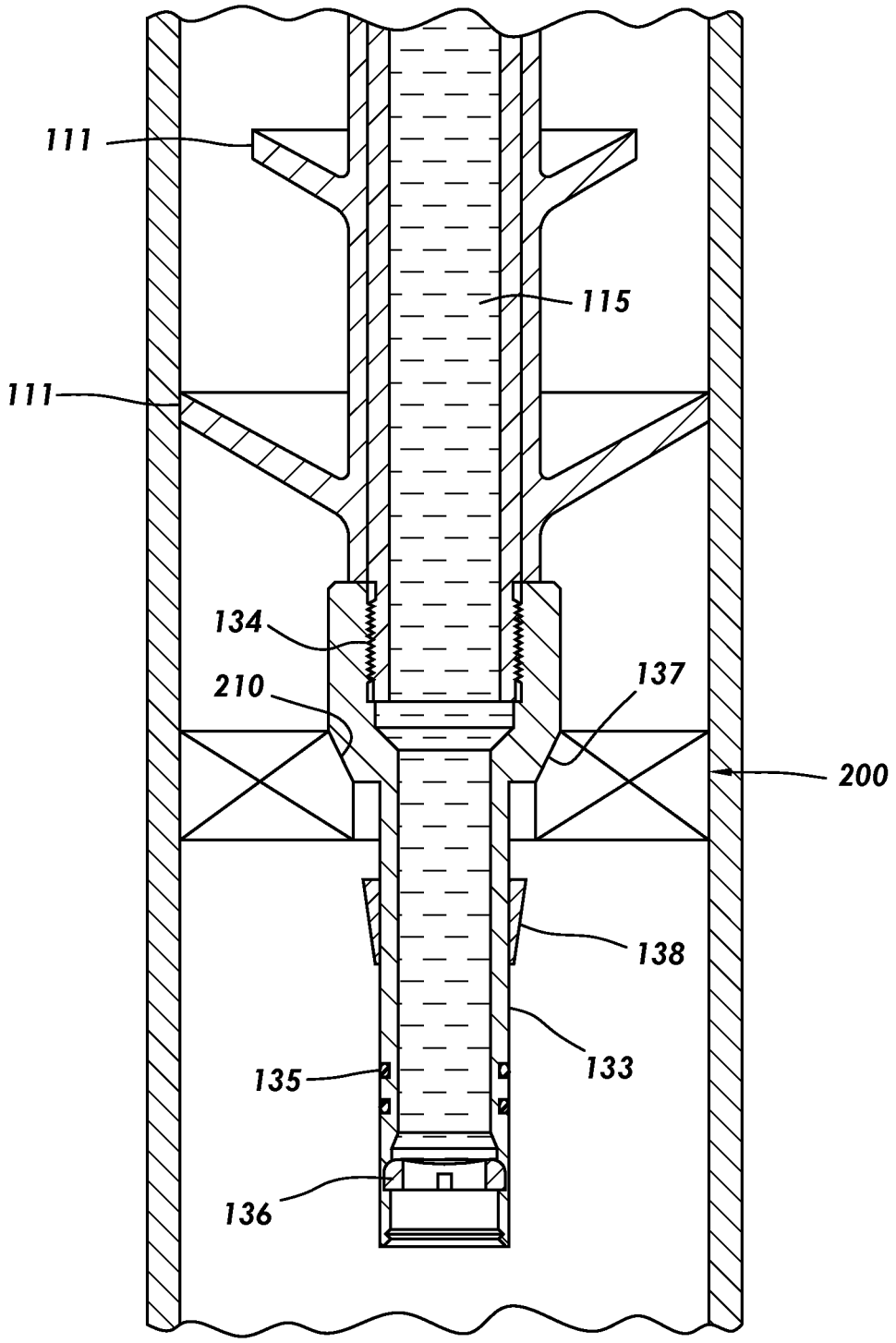
FIG. 3 is a cross-sectional view of the wiper plug of FIG. 2 landed on a landing device according to certain embodiments.

As shown in FIG. 3, the wiper plug 100 can land on a landing device 200, such as, but not excluding, a packer, landing collar, or cross-over tool. The nose 133 can include a nose shoulder 137. The nose shoulder 137 can shoulder up against a shoulder 210 of the landing device 200. The nose 133 can also include a locking device 138. The locking device 138 can be, for example, a lock ring, spring, or dog.

The wiper plug 100 can include a fishing neck 121. The fishing neck 121 can be located at the rear portion 120 of the wiper plug 100. The fishing neck 121 can be connected to the inner mandrel 110 via a threaded connection 122, glue, soldering, or welding for example. The fishing neck 121 can also be an integrally formed part of the inner mandrel 110 during manufacture. The fishing neck 121 can be used to engage with a fishing tool (not shown) in order to retrieve the wiper plug 100 from a tubing string. Accordingly, the fishing neck 121 can be secured to or formed as an integral part of the inner mandrel 110 such that upward force on the fishing neck 121 by the fishing tool does not cause the fishing neck 121 to separate from the inner mandrel 110 and the wiper plug 100 can be wholly retrieved. The fishing neck 121 can be made from metals, metal alloys, hard plastics, or fiber reinforced resins.

As shown in FIGS. 1 and 2, the fishing neck 121 can be a female fishing neck. The female fishing neck can allow fluids to flow through the fishing neck 121, the inner mandrel 110, and the nose 133 if included. A female fishing neck can include an interior fishing neck profile 123. The interior of the fishing neck can have a variety of profiles. The interior fishing neck profile 123 can be designed such that the profile of a male fishing tool can matingly engage with the female fishing neck in order to retrieve that wiper plug 100. Once the male fishing tool is inserted into the female fishing neck and the profiles align, the fishing tool can be used to retrieve the wiper plug from the tubing string.

Figure 4:
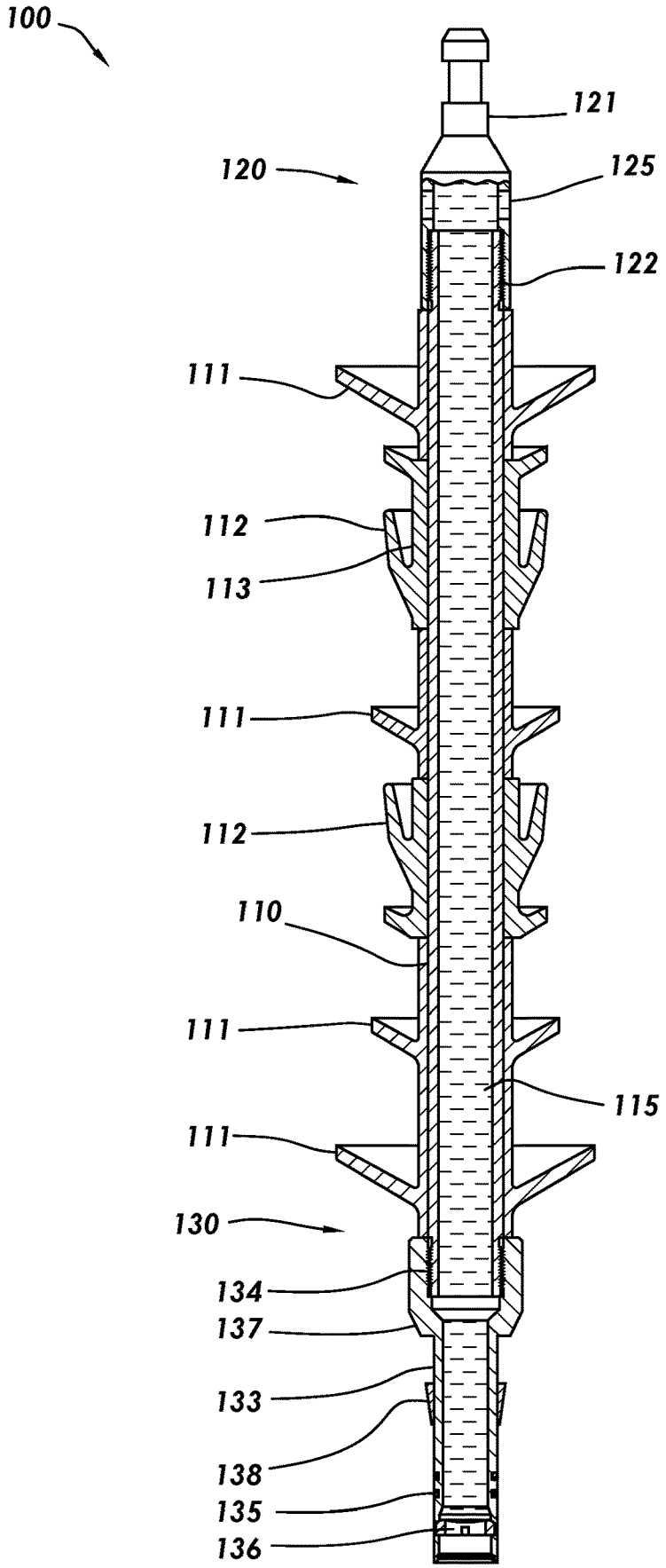
FIG. 4 is a cross-sectional view of a wiper plug with a male fishing neck according to certain other embodiments.

As shown in FIG. 4, the fishing neck 121 can be a male fishing neck. A male fishing neck can be solid or hollow. The male fishing neck can include one or more recesses for receiving a mating profile from a female fishing tool. An exterior male fishing neck profile can be selected to match an interior profile of the female fishing tool. In this manner, the female fishing tool can surround the male fishing neck and lock onto the fishing neck in order to retrieve the wiper plug 100 from the tubing string. The male fishing neck 121 can include one or more ports 125 located adjacent to the rear portion 120 of the inner mandrel 110. Fluid can flow through the ports 125 from the outside of the male fishing neck 121 and into the cavity of the inner mandrel 110.

Figure 5:
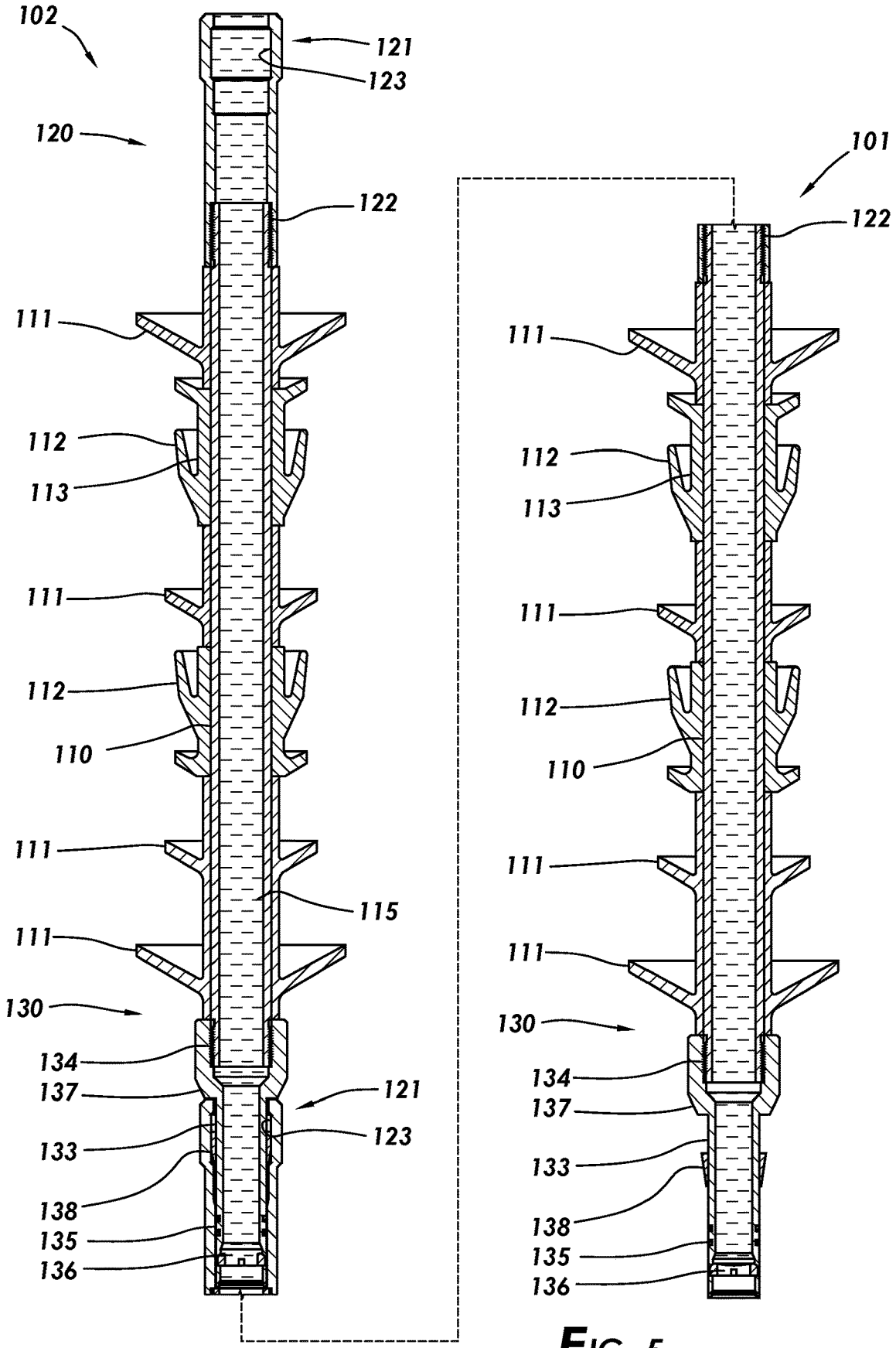
FIG. 5 is a cross-sectional view of two wiper plugs stacked according to certain embodiments.

FIG. 5 shows a second wiper plug 102 stacked onto a first wiper plug 101. According to these embodiments, the first wiper plug 101 can be introduced into a tubing string. The second wiper plug 102 can be introduced into the tubing string after the first wiper plug 101. The nose 133 of the second wiper plug 102 can enter the interior fishing neck profile 123 of the first wiper plug 101. The nose shoulder 137 of the second wiper plug 102 can shoulder up against the end of the fishing neck 121 of the first wiper plug 101 to prevent further penetration of the nose 133 into the fishing neck 121. The dimensions of the fishing neck 121 and the interior fishing neck profile 123 of the first wiper plug 101 can be selected to receive the nose 133 of the second wiper plug 102. A third or more wiper plugs 100 (not shown) can be stacked onto the second wiper plug 102.

Methods of cementing a wellbore can include introducing the wiper plug 101 into a tubing string. The step of introducing can be performed before a cement composition is introduced into the tubing string. According to this embodiment, a nose 133 of the wiper plug 101 can land on a landing device 200. A nose shoulder 137 can engage the top portion of the landing device 200. A pressure change can be observed at the wellhead by an operator. The methods can include increasing a pressure differential across a rupture disk 136 to rupture the disk. The methods can include introducing a fluid, for example water, into the tubing string wherein the fluid flows through the inner mandrel 110 and then nose 133, for example to rupture the rupture disk. According to any of the embodiments, a second wiper plug 102 can be introduced into the tubing string after the first wiper plug 101. A nose 133 of the second wiper plug 102 can land on a female fishing neck 121 of the first wiper plug 101. The sealing elements 135 of the nose 133 of the second wiper plug 102 can create a seal around a portion of the nose and the interior fishing neck profile 123 of the first wiper plug 101 such that fluid does not flow through the inner mandrel 110 of the first wiper plug 101 until rupturing of the rupture disk 136 of the second wiper plug 102 occurs. A cement composition or other fluid (hereinafter referred to as a cement composition) can be introduced into the tubing string after the first wiper plug 101 or after the second wiper plug 102. A rupture disk 124 of the first wiper plug 101 or second wiper plug 102 can be used to determine the location of the cement within the tubing string. The cement composition can also be introduced between the first wiper plug 101 and the second wiper plug 102. The cavity of the inner mandrel 110 of the second wiper plug 102 can be filled with a fluid that prevents the cement composition from entering the inner mandrel as the cement and second wiper plug are introduced into the tubing string. After the cement composition flows through the first wiper plug 101, the nose 133 of the second wiper plug 102 can land on the fishing neck 121 of the first wiper plug 101 and an operator at the wellhead can determine the location of the cement composition by observing a pressure change. A rupture disk 136 of the second wiper plug 102 can be ruptured.

According to any of the embodiments, only one wiper plug 100 is introduced into the tubing string. According to these embodiments, the wiper plug 100 is introduced after a cement composition has been introduced into the tubing string. The wiper plug 100 according to these embodiments can include, but does not have to include a nose 133. The wiper plug 100 can include a nut 131 and a rupture disk 124 located adjacent to the fishing neck 121 instead of a nose and a rupture disk located in the nose.

The methods can include retrieving the wiper plug 100 from the tubing string. The methods can include introducing a fishing tool (not shown) into the tubing string. The fishing tool can be a male fishing tool to engage with a female fishing neck or a female fishing tool to engage with a male fishing neck. The fishing tool can matingly engage with the fishing neck and the fishing tool and wiper plug can be pulled out of the tubing string. If two or more wiper plugs are stacked, for example as shown in FIG. 5, then according to any of the embodiments, the fishing tool can engage with the second wiper plug 102 and be used to retrieve the second wiper plug 102 from the tubing string while leaving the first wiper plug 101 in the tubing string. After the second wiper plug 102 has been retrieved, the fishing tool can be introduced again into the tubing string to retrieve the first wiper plug 101. Accordingly, each wiper plug can be retrieved separately from the tubing string.

According to certain other embodiments, the nose 133 of the second wiper plug 102 includes a locking device 138 that locks the second wiper plug 102 to the fishing neck 121 of the first wiper plug 101. A fishing tool can be introduced into the tubing string and matingly engage with the fishing neck 121 of the second wiper plug 102. Accordingly, both wiper plugs can be retrieved from the tubing string at the same time. According to these embodiments for stackable wiper plugs, the second wiper plug 102 can have a male or female fishing neck. However, the first wiper plug 101 cannot have a male fishing neck because the nose 133 of the second wiper plug 102 would not be capable of landing on a male fishing neck.

According to any of the embodiments, a top of a cement column is tagged by passing a tool, such as a spear, through the wiper plug 100.

An embodiment of the present disclosure is a wiper plug comprising: an inner mandrel; one or more wiper cups located circumferentially around the inner mandrel; and a fishing neck connected to a rear portion of the inner mandrel. Optionally, the wiper plug further comprises wherein the wiper plug further comprises one or more wiper cup connectors, wherein the one or more wiper cup connectors are located adjacent to the one or more wiper cups. Optionally, the wiper plug further comprises wherein the wiper plug further comprises a nut, wherein the nut is removably secured to a front portion of the inner mandrel. Optionally, the wiper plug further comprises wherein a cavity of the inner mandrel contains an incompressible fluid. Optionally, the wiper plug further comprises wherein the wiper plug further comprises a rupture disk located at the rear portion of the inner mandrel. Optionally, the wiper plug further comprises wherein the wiper plug further comprises a nose located at a front portion of the inner mandrel. Optionally, the wiper plug further comprises wherein the nose comprises an outer profile configured such that the nose of lands on a landing tool or a second wiper plug. Optionally, the wiper plug further comprises wherein the outer profile comprises a nose shoulder. Optionally, the wiper plug further comprises wherein the nose further comprises a locking device located adjacent to the nose shoulder on an outside of the outer profile. Optionally, the wiper plug further comprises wherein the nose further comprises a rupture disk located on an inside of the nose. Optionally, the wiper plug further comprises wherein the fishing neck is a female fishing neck, and wherein the female fishing neck has an interior fishing neck profile. Optionally, the wiper plug further comprises wherein the fishing neck is a male fishing neck, and wherein the male fishing neck comprises one or more fluid flow ports located adjacent to a rear portion of the inner mandrel.

Another embodiment of the present disclosure is a method of cementing a wellbore comprising: introducing a wiper plug into a tubing string located within the wellbore, wherein the wiper plug comprises: an inner mandrel; one or more wiper cups located circumferentially around the inner mandrel; and a fishing neck connected to a rear portion of the inner mandrel; and retrieving the wiper plug from the tubing string with a fishing tool. Optionally, the method further comprises wherein the wiper plug further comprises a nut, wherein the nut is removably secured to a front portion of the inner mandrel. Optionally, the method further comprises introducing a cement composition into the wellbore, and wherein the wiper plug is introduced into the tubing string before or after introduction of the cement composition. Optionally, the method further comprises wherein the wiper plug further comprises a nose located at a front portion of the inner mandrel. Optionally, the method further comprises landing the nose on a landing profile of a downhole tool. Optionally, the method further comprises introducing a second wiper plug into the tubing string, wherein the second wiper plug comprises a nose and a fishing neck. Optionally, the method further comprises wherein the fishing neck of the wiper plug is a female fishing neck, and wherein the nose of the second wiper plug lands on the female fishing neck. Optionally, the method further comprises wherein the nose of the second wiper plug further comprises a locking device; wherein the locking device engages with an interior fishing neck profile of the female fishing neck; and wherein the step of retrieving comprises: introducing a fishing tool into the tubing string; causing or allowing the fishing tool to matingly engage with the fishing neck of the second wiper plug; and applying an upward force on the fishing tool to retrieve the wiper plug and the second wiper plug simultaneously. Optionally, the method further comprises wherein the wiper plug further comprises one or more wiper cup connectors, wherein the one or more wiper cup connectors are located adjacent to the one or more wiper cups. Optionally, the method further comprises wherein a cavity of the inner mandrel contains an incompressible fluid. Optionally, the method further comprises wherein the wiper plug further comprises a rupture disk located at the rear portion of the inner mandrel. Optionally, the method further comprises wherein the nose comprises an outer profile configured such that the nose of lands on a landing tool or a second wiper plug. Optionally, the method further comprises wherein the outer profile comprises a nose shoulder. Optionally, the method further comprises wherein the nose further comprises a locking device located adjacent to the nose shoulder on an outside of the outer profile. Optionally, the method further comprises wherein the nose further comprises a rupture disk located on an inside of the nose. Optionally, the method further comprises wherein the fishing neck is a female fishing neck, and wherein the female fishing neck has an interior fishing neck profile. Optionally, the method further comprises wherein the fishing neck is a male fishing neck, and wherein the male fishing neck comprises one or more fluid flow ports located adjacent to a rear portion of the inner mandrel.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art and having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more wiper cups, wiper plugs, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A wiper plug comprising:

an inner mandrel, wherein the inner mandrel has an inner diameter and an outer diameter;

one or more wiper cups located circumferentially around the inner mandrel; and a fishing neck connected to a rear portion of the inner mandrel, wherein the fishing neck is secured to or formed as an integral part of the inner mandrel such that an upward force on the fishing neck by a fishing tool does not cause the fishing neck to separate from the inner mandrel and the wiper plug is wholly retrieved from a tubing string.

2. The wiper plug according to claim 1, wherein the wiper plug further comprises one or more wiper cup connectors, wherein the one or more wiper cup connectors are located adjacent to the one or more wiper cups.

3. The wiper plug according to claim 1, wherein the wiper plug further comprises a nut, wherein the nut is removably secured to a front portion of the inner mandrel.

4. The wiper plug according to claim 3, wherein the inner diameter forms a cavity within the inner mandrel, and wherein the cavity contains an incompressible fluid.

5. The wiper plug according to claim 4, wherein the wiper plug further comprises a rupture disk located at the rear portion of the inner mandrel.

6. The wiper plug according to claim 1, wherein the wiper plug further comprises a nose located at a front portion of the inner mandrel.

7. The wiper plug according to claim 6, wherein the nose comprises an outer profile configured such that the nose lands on a landing tool or a second wiper plug.

8. The wiper plug according to claim 7, wherein the outer profile comprises a nose shoulder.

9. The wiper plug according to claim 8, wherein the nose further comprises a locking device located adjacent to the nose shoulder on an outside of the outer profile.

10. The wiper plug according to claim 6, wherein the nose further comprises a rupture disk located on an inside of the nose.

11. The wiper plug according to claim 1, wherein the fishing neck is a female fishing neck, and wherein the female fishing neck has an interior fishing neck profile.

12. The wiper plug according to claim 1, wherein the fishing neck is a male fishing neck, and wherein the male fishing neck comprises one or more fluid flow ports located adjacent to a rear portion of the inner mandrel.

13. A method of cementing a wellbore comprising:

introducing a wiper plug into a tubing string located within the wellbore, wherein the wiper plug comprises:

an inner mandrel, wherein the inner mandrel has an inner diameter and an outer diameter;

one or more wiper cups located circumferentially around the inner mandrel; and a fishing neck connected to a rear portion of the inner mandrel, wherein the fishing neck is secured to or formed as an integral part of the inner mandrel such that an upward force on the fishing neck by a fishing tool does not cause the fishing neck to separate from the inner mandrel and the wiper plug is wholly retrievable from the tubing string; and retrieving the wiper plug from the tubing string with the fishing tool.

14. The method according to claim 13, wherein the wiper plug further comprises a nut, wherein the nut is removably secured to a front portion of the inner mandrel.

15. The method according to claim 14, further comprising introducing a cement composition into the wellbore, and wherein the wiper plug is introduced into the tubing string before or after introduction of the cement composition.

16. The method according to claim 13, wherein the wiper plug further comprises a nose located at a front portion of the inner mandrel.

17. The method according to claim 16, further comprising landing the nose on a landing profile of a downhole tool.

18. The method according to claim 13, further comprising introducing a second wiper plug into the tubing string, wherein the second wiper plug comprises an inner mandrel, one or more wiper cups located circumferentially around the inner mandrel, a nose, and a fishing neck connected to a rear portion of the inner mandrel.

19. The method according to claim 18, wherein the fishing neck of the wiper plug is a female fishing neck, and wherein the nose of the second wiper plug lands on the female fishing neck, and further comprising retrieving the second wiper plug from the tubing string with a fishing tool and then separately retrieving the wiper plug from the tubing string with the fishing tool.

20. The method according to claim 18, wherein the fishing neck of the wiper plug is a female fishing neck, and wherein the nose of the second wiper plug lands on the female fishing neck;

wherein the nose of the second wiper plug further comprises a locking device;

wherein the locking device engages with an interior fishing neck profile of the female fishing neck; and wherein the step of retrieving comprises:

introducing a fishing tool into the tubing string;

causing or allowing the fishing tool to matingly engage with the fishing neck of the second wiper plug; and applying an upward force on the fishing tool to retrieve the wiper plug and the second wiper plug together simultaneously.

* * * * *